United States Patent [19]

Bulatovic

[11] Patent Number: 4,772,382

[45] Date of Patent: Sep. 20, 1988

[54] FROTH FLOTATION OF BASTNAESITE

[75] Inventor: Srdjan Bulatovic, Peterborough, Canada

[73] Assignees: Falconbridge Limited, Toronto; Highwood Resources Ltd., Vancouver, both of Canada

[21] Appl. No.: 933,845

[22] Filed: Nov. 24, 1986

[30] Foreign Application Priority Data

Sep. 5, 1986 [CA] Canada ..... 517639

[51] Int. Cl.[4] ..... B03D 1/02

[52] U.S. Cl. ..... 209/166; 252/61; 423/21.1; 75/2

[58] Field of Search ..... 423/21.1; 75/2; 209/162, 163, 164, 165, 166, 167; 252/61

[56] References Cited

U.S. PATENT DOCUMENTS 3,909,399 9/1975 Petrovich ..... 209/166

FOREIGN PATENT DOCUMENTS 119456 9/1980 Japan ..... 209/166
45758 3/1983 Japan ..... 209/167
536506 1/1957 Canada ..... 209/166

*Primary Examiner*—Kenneth M. Schor
*Assistant Examiner*—Thomas M. Lithgow
*Attorney, Agent, or Firm*—Rogers, Bereskin & Parr

[57] ABSTRACT

A process is described for the mineral separation of rare earth metal compounds, such as bastnaesite, contained in oxidic minerals. The process is a froth flotation process utilizing a novel collector emulsion, which is an emulsified mixture of:

a secondary amine modified sulphonated fatty acid,
a high rosin containing tall oil fatty acid,
an anionic petroleum sulphonate, and
a high molecular weight primary amine.

The collector emulsion mixture is added to the aqueous slurry of the comminuted rare earth metal compound containing oxidic mineral, which has been previously conditioned in a conventional manner. The conditioning reagents may include alkaline pH modifiers and gangue depressants such as citric acid, oxalic acid, sodium silicates and fatty acids.

The rare earth metal compounds will be concentrated in the froth, and are separated in the conventional manner.

9 Claims, 1 Drawing Sheet

FROTH FLOTATION OF BASTNAESITE

This invention is related to the mineral separation of rare earth metal bearing compounds.

Rare earth metals are often used in the ceramic industry for ceramic oxide preparations and also as alloy additive for high purity precision alloys. The minerals containing rare earth metals are widely dispersed, and intergrown with several oxides forming the Earth Crust. As a consequence, they are very difficult to separate and special methods and reagents are required to obtain a rare earth mineral concentrate. The mineral bastnasite falls in the category generally referred to as rare earth metal fluocarbonate and is often accompanied by fluorite, hematite, quartz, barite, calcite, limonite and various other silicate containing minerals.

There are known methods that satisfactorily separate bastnaesite from its accompanying minerals. These are, however, expensive and costly to operate. One prior art publication can be found in Japanese Patent No. 55-19465, which discloses the use of petroleum sulphonic acid as a collector in a mineral process for the separation of bastnaesite from its accompanying minerals. According to this process the reagent is added at pH 8.5 to 10.5 in a first flotation step to depress the rare earth containing minerals. The tailings obtained are subsequently heated to above 65° C. with the pH having been adjusted to 6.5 to 8.5 and then subjected to a second flotation step. The bastnaesite is recovered from the froth of the second flotation process step.

Another method described in the literature is the use of hydroxamic acid in the separation of rare earth metal oxides in predominantly iron oxides containing minerals. This process also requires several preconditioning stages.

A new process has been found for the flotation separation of rare earth metal compounds contained in oxidic minerals wherein a collector emulsion mixture is added to an aqueous slurry of the comminuted oxidic rare earth metal containing minerals, said collector emulsion mixture comprises:

(a) 23 to 33 wt. % of a secondary amine modified sulphonated fatty acid, having 18–20 carbon atoms in the hydrocarbon chain which is linked to the carboxyl group of said fatty acid;
(b) 40 to 50 wt. % high rosin containing, tall oil fatty acid;
(c) 15 to 20 wt. % anionic petroleum sulphonate; and
(d) 5 to 15 wt. % high molecular weight primary amine of general formula $Ra''NH_2$, wherein R'' is a hydrocarbon radical containing alkyl and aryl groups.

The aqueous slurry of comminuted rare earth metal compound containing minerals is subsequently subjected to froth flotation treatment.

The collector is pre-mixed in the above proportions preferably at higher than ambient temperature to form an emulsion, and is added to the conditioned ore in the conventional manner. It was found that the reagent mixture of this invention is highly selective and is especially effective in the separation of bastnaesite. This process provides high grade of recovery at relatively low costs.

The preferred embodiment of this invention will now be described in detail as is utilized in a mineral separation process, and by way of examples.

FIG. 1 illustrates a flowsheet for the continuous flotation separation of ceria, as described in Example 3 of the disclosure.

DETAILED DESCRIPTION

Figure 1:
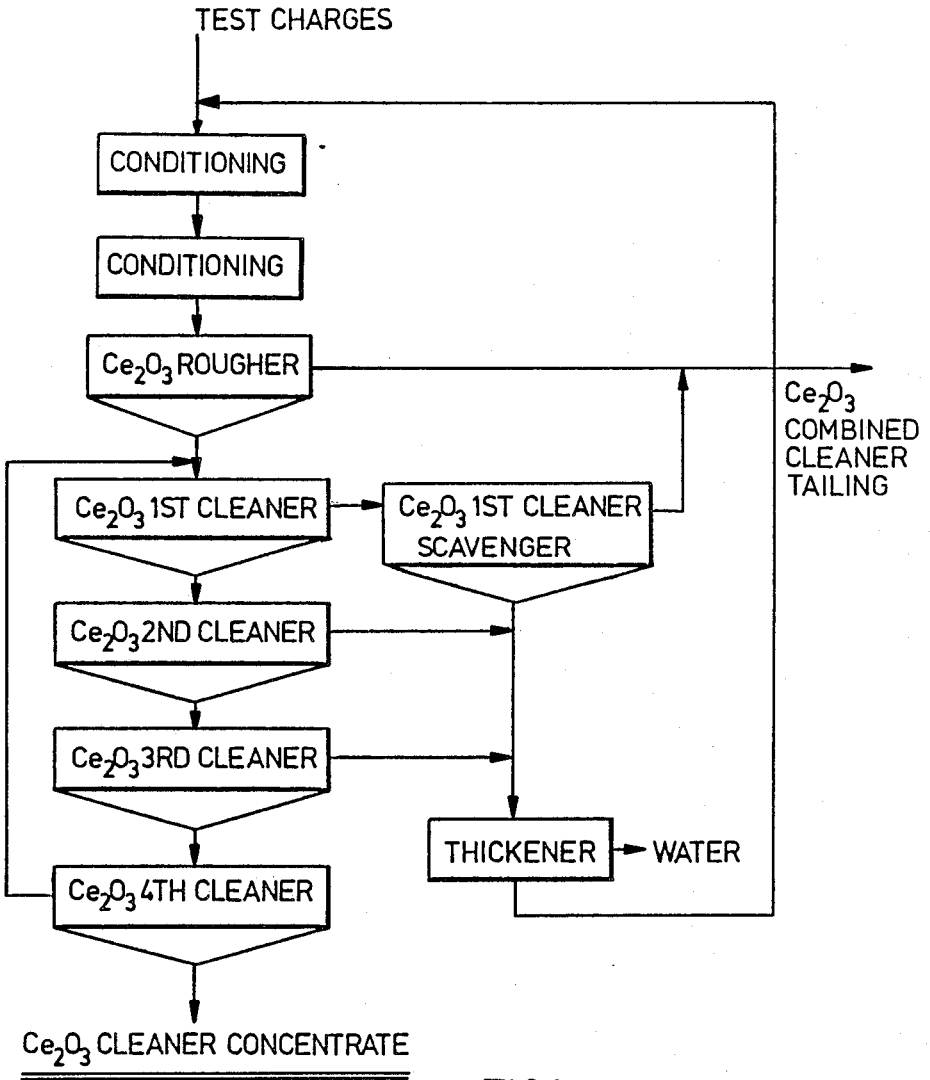

It has been found that for best results the ore is conditioned before applying the emulsion mixture of this invention. The minerals containing the rare earth metal compound, in this instance rare earth fluocarbonates, are first ground to a size to liberate the rare earth metal compound from the accompanying oxide gangue. The comminuted ore is then slurried in water to provide a pulp density which conveniently ranges between 30 to 38% solid content. The optimum pulp density, however, is dictated by the nature and structure of the minerals accompanying the bastnaesite. The slurry obtained is subsequently conditioned for 5 to 30 minutes in presence of a pH modifier and an oxide gangue depressant. A convenient pH modifier is sodium carbonate or caustic soda, but any suitable alkaline reagent may be used to establish a pH of 9 to 10 in the pulp.

The choice of depressant depends on the accompanying minerals; citric acid or oxalic acid may be used in cases of host materials such as quartz, dolomite, calcite, barite, or gangue minerals of similar nature. Gangue minerals which contain silicates or iron oxides, such as hematite or limonite, can be depressed by the use of sodium silicates. An alkali metal hydrogen sulphide, such as sodium hydrosulphide is useful in depressing flourite, albite and mica, and in addition it will also act as pulp dispersant. Any of the above reagents or their chemical equivalents, or a combination of them will serve in conditioning the ore for flotation separation of rare earth minerals by the application of the emulsion of this invention. The choice of the suitable depressant and the quantity to be used in the case of a given mineral composition will be arrived at by those skilled in the art.

The conditioned pulp is treated with the pre-mixed collector emulsion of the present invention for 5 to 15 minutes in quantities of about 150 to 400 g/t.

The collector emulsion of the present invention is made up of the following components:

(a) a secondary amine modified sulphonated fatty acid having branched or straight, saturated or unsaturated aliphatic chain containing 19 to 21 carbon atoms. An exemplary reagent of this nature is "Lilaflot OS100" marketed by the Keno Gard Company;
(b) a high rosin-tall oil fatty acid, having saturated or unsaturated aliphatic chain. A reagent of this type is marketed by Arizona Chemicals under the name "D30LR", but may be substituted by chemical equivalents;
(c) an anionic petroleum sulphonate, encompassing the group

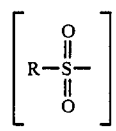

;

and (d) A high molecular weight primary amine having the general formula $R''NH_2$, wherein R'' may represent alkyl or aryl groups, or combinations thereof. An example of such a compound is dehydroabiethylamine, but other complex hydrocarbon radical containing primary amine may be used, which is capable of imparting cationic functionality.

The emulsion is made up by mixing with agitation: in the following proportions:

23 to 33 wt. % of the sulphonated amino fatty acid,
40 to 50 wt. % of high rosin - tall oil fatty acid,
15 to 20 wt. % petroleum sulphonate, and
5 to 15 wt. % high molecular weight primary amine. It has been found that mixing at an elevated temperature of 45°-55° C. will enhance the efficacy of the emulsion. The appropriate proportions of the ingredients are selected within the above ranges to provide the desired selectivity with respect to the particular rare earth metal present in the ore.

In conventional flotation processes, the froth of the rougher flotation stage is subjected to several cleaner flotation stages. The number of flotation stages used in the mineral separation process is dictated by the initial concentration of the desired mineral to be separated, and on the economics of the process. It was found that in the present process supplementary additions of the depressant in the cleaner flotation stages enhance the effectiveness of the collector emulsion in obtaining higher selectivity.

The conditioning with the appropriate depressant and the collector emulsion mixture according to the mineral separation process described hereinabove may be carried out on deslimed or undeslimed ore, and by the use of conventional mineral processing equipment.

The effectiveness of the collector emulsion in the separation of rare earth metal containing compounds, in particular in the separation of bastnaesite, from oxidic ores and minerals will be better understood by those skilled in the art by having regard to the following examples which illustrate the working of the mineral separation process of the present invention.

EXAMPLE 1

A laboratory test was carried out on an ore containing bastnaesite, accompanied by quartz, fluorite, calcite and mica, using conventional reagents. The ore was ground to a fineness of 100% ≦ 100 mesh and slurried in water to yield a pulp density of 35% solids. The following reagents were used in gram per ton of ore, denoted as g/t.

| | | |
|---|---|---|
| Reagents | $Na_2C0_3$ | 2000 g/t (to adjust pH to 9.6) |
| | Citric Acid | 800 g/t |
| | Na Silicate | 800 g/t |
| | Fatty Acid | 1000 g/t |
| | NaHS | 400 g/t |

The results are tabulated in Table I.

TABLE I

| Product | Weight % | Assays, % $Ce_2O_3$ | % Distribution $Ce_2O_3$ |
|---|---|---|---|
| $Ce_2O_3$ Cleaner Conc. | 10.54 | 26.10 | 69.4 |
| $Ce_2O_3$ Rougher Conc. | 46.64 | 7.33 | 86.3 |
| $Ce_2O_3$ Rougher Tail. | 53.36 | 1.12 | 13.7 |
| Flotation Feed | 100.00 | 3.97 | 100.0 |

The selectivity between bastnaesite and oxide gangue minerals was poor, and it can be seen that the concentrate grade and mineral recovery was low.

EXAMPLE 2

A mineral separation test was conducted on an ore sample of similar composition as in Example 1, using the same conditioning treatment for pH adjustment and same depressants. After the initial conditioning period of 20 minutes, the collector emulsion of the present invention was added and the slurry was conditioned for further 10 minutes, and then subjected to rougher and cleaner flotation stages.

An emulsion was prepared by mixing the components in the following ratios:

| | |
|---|---|
| A secondary amine modified sulphonated fatty acid having 19-21 carbon atoms, such as Lilaflot OS100, | 28% by wt. |
| High rozin containing tall oil fatty acid, such as D30RL | 44% by wt. |
| Anionic petroleum sulphonate | 18% by wt. |
| High molecular weight primary amine $R''NH_2$, such as dehydroabiethyl amine | 10% by wt. |

This emulsion will be referred to in the following as "Emulsion CD".

The reagents used in the mineral separation process for the separation of ceria containing bastnaesite:

| | |
|---|---|
| $Na_2CO_3$ | 2000 g/t (pH adjustment to 9.6) |
| Citric Acid | 800 g/t |
| Na Silicate | 800 g/t |
| NaHS | 400 g/t |
| Emulsion CD | 300 g/t |

The results are tabulated Table II below.

TABLE II

| Product | Weight % | Assays, % $Ce_2O_3$ | % Distribution $Ce_2O_3$ |
|---|---|---|---|
| $Ce_2O_3$ Cleaner Conc. | 11.73 | 30.0 | 88.4 |
| $Ce_2O_3$ Rougher Conc. | 18.35 | 21.0 | 96.9 |
| $Ce_2O_3$ Rougher Tail. | 81.65 | 0.15 | 3.1 |
| Flotation Feed | 100.0 | 3.98 | 100.0 |

Comparisons of results of Examples 1 and 2 shows that the new collector emulsion is highly selective with respect to ceria present as bastnaesite contained in oxidic gangue minerals and it also gives high mineral recoveries.

EXAMPLE 3

A continuous laboratory test was carried out on the ore used in Examples 1 and 2, with the application of the new collector emulsion CD described in Example 2, for simulating a commercial continuous circuit. The flowsheet of the continuous separation process is shown in FIG. 1.

Reagents were fed as shown below:

| | |
|---|---|
| $Na_2CO_3$ | 2000 g/t |
| Citric Acid | 800 g/t |
| Na Silicate | 800 g/t |
| NaHS | 300 g/t |
| Emulsion CD | 250 g/t |

The results of the continuous mineral separation process are shown in Table III.

TABLE III

| Product | Weight % | Assays, % $Ce_2O_3$ | % Distribution $Ce_2O_3$ |
|---|---|---|---|
| $Ce_2O_3$ Cleaner Conc. | 13.23 | 29.82 | 94.6 |
| $Ce_2O_3$ Final Tail. | 86.77 | 0.26 | 5.4 |

TABLE III-continued

| Product | Weight % | Assays, % $Ce_2O_3$ | % Distribution $Ce_2O_3$ |
|---|---|---|---|
| Flotation Feed | 100.0 | 4.17 (Initial conc. in the ore | 100.0 |

It is clearly demonstrated that the new collector emulsion of this invention gives good separation at generally very economical dosage levels. Furthermore, the level of addition of some other conventional reagents, such as sodium hydrosulphide, may also be lowered.

Another advantage of the flotation process of the present invention is its simple operation with readily available reagents, with the application of standard flotation equipment and by the use of conventional techniques.

I claim:

1. A method for the froth flotation separation of rare earth metal compounds contained in oxidic minerals comprising (i) adding a premixed collector emulsion mixture selective to the rare earth metal compounds, to an aqueous slurry of oxidic minerals, said collector emulsion comprising:

(a) 23 to 33 wt. % of a secondary amine modified sulphonated fatty acid, having 18–20 carbon atoms in the hydrocarbon chain which is linked to the carboxyl group of said fatty acid;

(b) 40 to 50 wt. % high rosin containing, tall oil fatty acid;

(c) 15 to 20 wt. % anionic petroleum sulphonate; and, (d) 5 to 15 wt. % high molecular weight primary amine of general formula $R''NH_2$, wherein R'' is a hydrocarbon radical containing alkyl and aryl groups;

(ii) subjecting the aqueous slurry containing said collector emulsion mixture to froth flotation wherein the rare earth metal compounds are selectively concentrated in the froth.

2. A method as recited in claim 1 wherein said aqueous slurry of said oxidic minerals is conditioned with pH modifier and a gangue depressant prior to the addition of said collector emulsion mixture.

3. A method as recited in claim 2 wherein said pH modifier is one of the group consisting of alkali metal carbonates and alkali metal hydroxides.

4. A method as recited in claims 2 wherein said gangue depressant is at least one of the group consisting of sodium silicate, citric acid, oxalic acid, and alkali metal hydrogen sulphide.

5. A method as recited in claim 2 wherein said flotation separation comprises a rougher flotation stage and at least one cleaner flotation stage.

6. A method for the flotation separation of rare earth metal compounds contained in oxidic minerals comprising the steps of:

(i) communicating an oxidic mineral containing rare earth metal compounds to liberation size and forming an aqueous slurry with said comminuted oxidic mineral;

(ii) adding a pH modifier and a depressant to said aqueous slurry thereby subjecting said slurry to a first conditioning treatment;

(iii) premixing a collector emulsion comprising:

(a) 23 to 33 wt. % of a secondary amine modified sulphonated fatty acid having 18–20 carbon atoms in the hydrocarbon chain, which is linked to carboxyl group of said fatty acid.

(b) 40 to 50 wt. % high rosin containing, tall oil fatty acid, (c) 15 to 20 wt. % anionic petroleum sulphonate, and (d) 5 to 15 wt. % high molecular weight primary amine of general formula $R''NH_2$, where R'' is a hydrocarbon radical containing alkyl and aryl groups, and adding said collector emulsion mixture to condition said aqueous slurry in a second conditioning treatment; and (iv) subjecting said second conditioned slurry to froth flotation to yield a rare earth metal compound bearing froth and an oxidic mineral bearing tailing.

7. A method according to claim 6 wherein said froth flotation of step (iv) comprises a rougher flotation stage and at least one cleaner flotation stage.

8. A method according to claim 1, 6 or 7 wherein said rare earth metal compound is bastnaesite.

9. A method according to claim 1 or 6 wherein said collector emulsion is premixed at a temperature less than 60° C.

* * * * *